US011074896B1

(12) United States Patent
Vater et al.

(10) Patent No.: US 11,074,896 B1
(45) Date of Patent: Jul. 27, 2021

(54) DRUMSTICK WITH ENHANCED PROTECTION AGAINST WEAR AND BREAKAGE IN THE RIMSHOT AREA OF THE DRUMSTICK

(71) Applicants: Alan J. Vater, Holbrook, MA (US); John A. Coviello, Holbrook, MA (US)

(72) Inventors: Alan J. Vater, Holbrook, MA (US); John A. Coviello, Holbrook, MA (US)

( * ) Notice: Subject to any disclaimer, the term of this patent is extended or adjusted under 35 U.S.C. 154(b) by 0 days.

(21) Appl. No.: 15/880,463

(22) Filed: Jan. 25, 2018

(51) Int. Cl.
*G10D 13/12* (2020.01)

(52) U.S. Cl.
CPC ..... *G10D 13/12* (2020.02)

(58) Field of Classification Search
CPC ..... G10D 13/003; G10D 13/12
See application file for complete search history.

(56) References Cited

U.S. PATENT DOCUMENTS 3,585,897 A * 6/1971 Stalcup ..... G10D 13/003 84/422.4
4,462,296 A * 7/1984 Heiskell ..... G10D 13/003 84/422.4
5,265,514 A * 11/1993 Schertz ..... G10D 13/003 446/419
5,341,716 A * 8/1994 Donohoe ..... G10D 13/003 84/422.4
5,728,958 A * 3/1998 Vater ..... G10D 13/003 84/422.4
6,002,077 A * 12/1999 Nicolosi ..... G10D 13/003 84/422.1
6,310,278 B1 * 10/2001 Butler ..... G10D 13/003 84/422.4
6,326,535 B1 * 12/2001 Pokallus ..... G10D 13/003 84/422.4
8,163,989 B2 * 4/2012 Richard ..... G10D 13/003 84/422.4
10,269,333 B1 * 4/2019 Vater ..... G10D 13/12

* cited by examiner

*Primary Examiner* — Robert W Horn
(74) *Attorney, Agent, or Firm* — Ross Weinzimmer & Associates, P.C.

(57) ABSTRACT

An extended play drumstick with enhanced durability of the rimshot area. The extended play drumstick includes a durable surrounding pad attached along and around the rimshot portion of the drumstick, and features an optional durable coating applied to the surface of the drumstick shaft, applied from at least the distal end of the durable surrounding pad up to and including at least the shoulder portion. The extended play drumstick resists rimshot damage caused by the drumstick striking the rim of a drum. The rimshot area of the drumstick is protected with a durable surrounding pad made of high strength material such as a para-aramid synthetic fiber, e.g., Kevlar® fiber from Dupont®. The extended play drumstick prevents chipping, fraying, and splintering of the shaft of the drumstick. Due to the light weight of the durable surrounding pad, and the durable coating, the balance and feel of a traditional drumstick are preserved.

12 Claims, 3 Drawing Sheets

DRUMSTICK WITH ENHANCED PROTECTION AGAINST WEAR AND BREAKAGE IN THE RIMSHOT AREA OF THE DRUMSTICK

FIELD OF THE INVENTION

This invention relates generally to drumsticks, and more particularly to drumsticks with enhanced durability.

BACKGROUND OF THE INVENTION

Traditional wood drumsticks are often used to play "rimshots", a rimshot being performed by simultaneously striking a drum head with the tip of a drumstick, while also striking the rim of the drum with the side of the drumstick, resulting in a desirable accented drum sound. The rimshot portion of a drumstick is the portion of the drumstick that comes into contact with the rim during a rimshot, which is generally the middle region along the shaft of the drumstick. Repeated impact of the shaft with the rim of the drum causes damage to the rimshot portion, including chipping, fraying, and splintering of the wood of the shaft. In addition to rimshot damage, striking a traditional drumstick against cymbals (e.g., high-hat cymbals) can cause damage to both the shoulder portion and the tip portion of the drumstick.

Donohoe, U.S. Pat. No. 5,341,718 teaches a polymer sleeve embedded in a channel milled into the shaft, the polymer sleeve having greater resistance to rimshot damage than the wood of the shaft. However, the method of fabrication involves wood milling steps that narrow the shaft, thereby weakening it, and changing the balance and "feel" of the drumstick. Then, injection molding is used to apply molten fiberglass-filled nylon polymer so as to form a structure that covers the rimshot area of the drumstick. The balance and feel of the drumstick is thereby further altered from the desirable "wood feel" of a traditional wood drumstick, also resulting in an unfavorable sound when the polymer sleeve strikes the rim when performing rimshots.

SUMMARY OF THE INVENTION

The drumstick of the invention has enhanced protection against wear and breakage in the rimshot area of the drumstick. The rimshot area of the drumstick is protected by a durable surrounding pad which includes an impact-resistant material, such as a para-aramid synthetic fiber, an example of which is Kevlar®, made by Dupont®. Para-aramid synthetic fibers have a tensile strength that is approximately 6 times the strength of high strength steel, and have a specific strength that is approximately 80 times the specific strength of high strength steel. The durable surrounding pad prevents damage to the rimshot area of the drumstick, thereby avoiding chipping, fraying, and splintering of the wooden shaft of the drumstick, while preserving the balance and feel of a traditional wood drumstick.

In addition, the drumstick of the invention can include a durable coating that protects the tip portion and the shoulder portion of the drumstick from early chipping and cracking.

Because of the light weight of the durable surrounding pad and the durable coating, the playability of the drumstick is not significantly altered from that of a traditional wood drumstick.

A general aspect of the invention is an extended play drumstick with enhanced durability. The extended play drumstick includes: a drumstick having a butt portion, a shaft portion, a shoulder portion, a tip portion, and a rimshot portion extending along some of the shaft portion; a durable surrounding pad attached along and around the rimshot portion, the durable surrounding pad having a distal end and a proximal end; and a durable coating applied to a surface of the shaft portion from at least the distal end of the durable surrounding pad up to and including at least the shoulder portion.

In some embodiments, the durable surrounding pad is attached to the rimshot portion by an adhesive.

In some embodiments, the durable surrounding pad includes an adhesive backing.

In some embodiments, the durable surrounding pad includes at least one of: poly-paraphenylene terephthalamide fiber, diaminodiphenylether-para-phenylenediamine-terephthaloyldichloride fiber, and carbon fiber.

In some embodiments, the durable surrounding pad is sized so as to form an abutting seam when the durable surrounding pad is attached along and around the rimshot portion.

In some embodiments, the extended play drum stick further includes a seam protective tape applied over and along the abutting seam.

In some embodiments, the durable surrounding pad is sized so as to form an overlapping seam when the durable surrounding pad is attached along and around the rimshot portion.

In some embodiments, the extended play drum stick further includes a seam protective tape applied over and along the overlapped seam.

In some embodiments, the seam protective tape is made from PET plastic film.

In some embodiments, the durable surrounding pad is between 2.5 and 4.0 inches in longitudinal length.

Another general aspect of the invention is an extended play drumstick with enhanced durability. This extended play drumstick includes: a drumstick having a butt portion, a shaft portion, a shoulder portion, a tip portion, and a rimshot portion extending along some of the shaft portion; and a durable surrounding pad attached along and around the rimshot portion.

In some embodiments, the durable surrounding pad is attached to the rimshot portion by an adhesive.

In some embodiments, the durable surrounding pad includes an adhesive backing.

In some embodiments, the durable surrounding pad includes at least one of: poly-paraphenylene terephthalamide fiber, diaminodiphenylether-para-phenylenediamine-terephthaloyldichloride fiber, and carbon fiber.

In some embodiments, the durable surrounding pad is sized so as to form an abutting seam when the durable surrounding pad is attached along and around the rimshot portion.

In some embodiments, the extended play drumstick further includes a seam protective tape applied over and along the abutting seam.

In some embodiments, the durable surrounding pad is sized so as to form an overlapping seam when the durable surrounding pad is attached along and around the rimshot portion.

In some embodiments, the extended play drumstick further includes a seam protective tape applied over and along the overlapping seam.

In some embodiments, the seam protective tape is made from PET plastic film.

In some embodiments, the durable surrounding pad is between 2.5 and 4.0 inches in longitudinal length.

BRIEF DESCRIPTION OF THE DRAWINGS

Many additional features and advantages will become apparent to those skilled in the art upon reading the following description, when considered in conjunction with the accompanying drawings, wherein.

DETAILED DESCRIPTION

Figure 1:
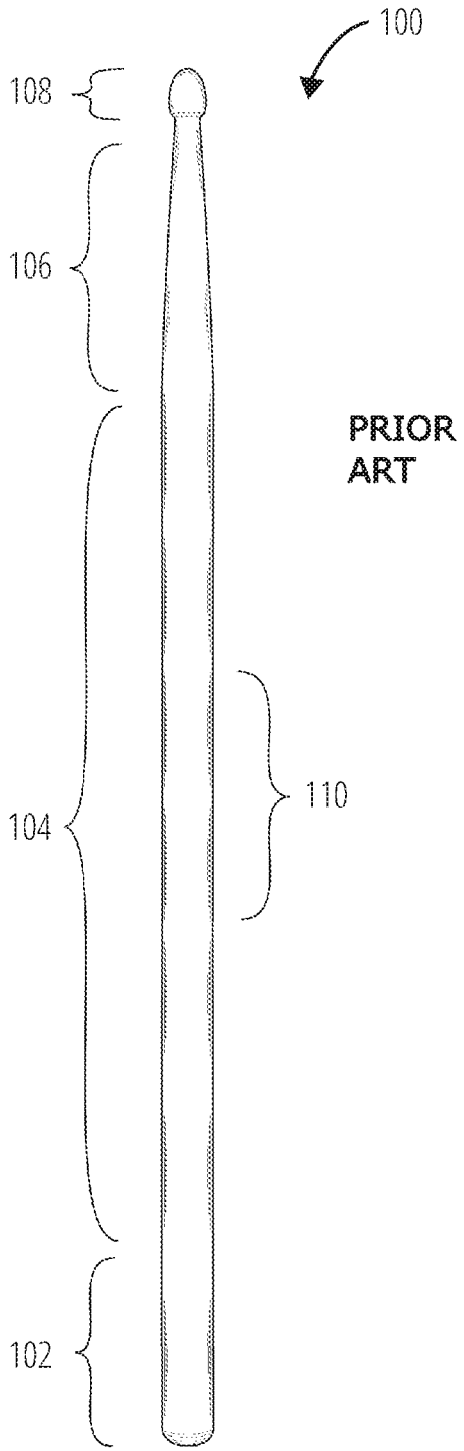
FIG. 1 is a side view showing the portions of a traditional drumstick, also showing the rimshot portion of the drumstick.

FIG. 1 is a side view of a traditional drumstick 100 showing a butt portion 102, a shaft portion 104, a shoulder portion 106, and a tip portion 108. The rimshot portion 110 is located generally within a middle portion of the shaft portion 104 of the traditional drumstick 100. The rimshot portion 110 is the area along the shaft portion 104 that most people tend to strike upon the rim when playing a rimshot. Thus, the rimshot portion 110 is the portion of the drumstick that includes the places along the shaft portion 104 that tend to strike the rim of a drum when playing a rimshot. Ordinary drum sticks start to suffer rimshot fatigue in the rimshot portion 104, showing chipping, fraying, and splintering, and eventually crack or break somewhere in the rimshot portion after a sufficiently large number of impacts against the rim of the drum.

The tip portion 108 is often made of wood, and the wood tip portion 108 can sometimes be covered with nylon to provide a nylon tip (not shown).

Figure 2A:
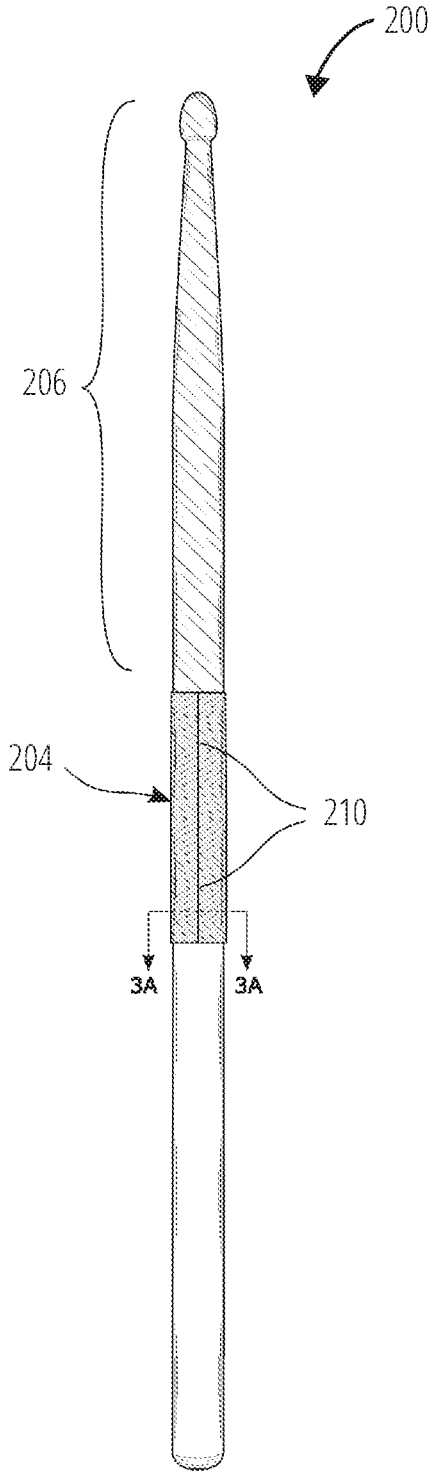
FIG. 2A is a side view of the extended play drumstick with a durable surrounding pad covering the rimshot portion, and a durable coating covering the shoulder and tip portions.

FIG. 2A is a side view of an extended play drumstick 200, including a durable surrounding pad 204 with an abutting seam 210. The durable surrounding pad 204 is applied at the rimshot portion 110 of the traditional drumstick 100 (both shown in FIG. 1).

The durable surrounding pad 204 includes a layer of ballistic fiber, such as a layer of poly-paraphenylene terephthalamide fiber (sold as Kevlar® by Dupont®), or diaminodiphenylether-para-phenylenediamine-terephthaloyldichloride fiber (sold as Technora® by Teijin Aramid in the Netherlands), or carbon fiber. Nylon fiber also has ballistic properties that can be effective.

The durable surrounding pad 204 also includes a layer of pressure sensitive adhesive (PSA). Adhesives which are based on natural or synthetic rubbers, and which are formulated with tackifying resins, oils, and anti-oxidants are preferred. A PSA based on rubber is also the most cost-effective, and offers quick adhesion.

PSA is applied to the ballistic layer as a relatively thin flexible layer. The durable surrounding pad 204 having a PSA layer will adhere with pressure to the shaft of a drumstick when the surface of the shaft is clean and dry. The shaft can be made from any one of: coated wood, uncoated wood, plastic, or metal. The PSA adhesive bonds to the surface of the shaft of the traditional drumstick 100 in proportion to the amount of pressure applied to the durable surrounding pad 204.

The durable surrounding pad 204 is between 2.5 inches and 4.0 inches in longitudinal length. In preferred embodiments, the durable surrounding pad 204 is substantially 3 inches in longitudinal length. When the durable surrounding pad 204 is configured to be used with a standard 5 Series drumstick, the durable surrounding pad 204 is at least 2. 5 inches in longitudinal length. Similarly, the durable surrounding pad 204 can be commensurately sized so as to be used with any of: 2 Series drumsticks, 3 Series drumsticks, 7 Series drumsticks, 8 Series drumsticks, Power 5A drumsticks, Power 5B drumsticks, MV7 Marching Snare Sticks, and MV8 Marching Snare Sticks.

In this embodiment, a durable coating 206 is applied to both the shoulder portion 106 and the tip portion 108 (shown in FIG. 1).

For example, the durable coating 206 can be an impact resistant coating, such as "DuraShield™ 310", sold by LifeLast, Inc., Pflugerville, Tex. DuraShield™ coating provides a barrier of protection for ferrous and non-ferrous metals, fiberglass, and wood; all materials used to make drumsticks. DuraShield™ coating has epoxy-like chemical and water resistance; rapid cure times; easy coverage; build capabilities of 20 mils or more; minimal out-gassing and pinholing; abrasion resistance; good flexibility—expands and contracts with the substrate (such as wood); and great impact resistance.

Or, the durable coating 206 can be made from Impact Coating™, by GCC Coatings, PowderCoatMDF.com A Division of Greenberg Casework Company Inc., South Beloit, Ill. Impact Coating™ combines polyurethane and polyurea to provide a coating that has a Shore D Hardness of 55+, and an impact resistance per ft/lbs of 4.5. The shoulder and tip of the drumstick is thereby protected by a coating that serves as a high impact-resistant shield.

Or, the durable coating 206 can be the durable coating as taught in co-pending U.S. patent application titled: A DURABLE ALIPHATIC MOISTURE CURE POLYURETHANE COATING FOR PROTECTING THE TIP AND SHOULDER AREA OF A WOOD DRUMSTICK, application Ser. No. 16/013,756, Filed Jun. 20, 2018, herein incorporated by reference in its entirety.

Figure 2B:
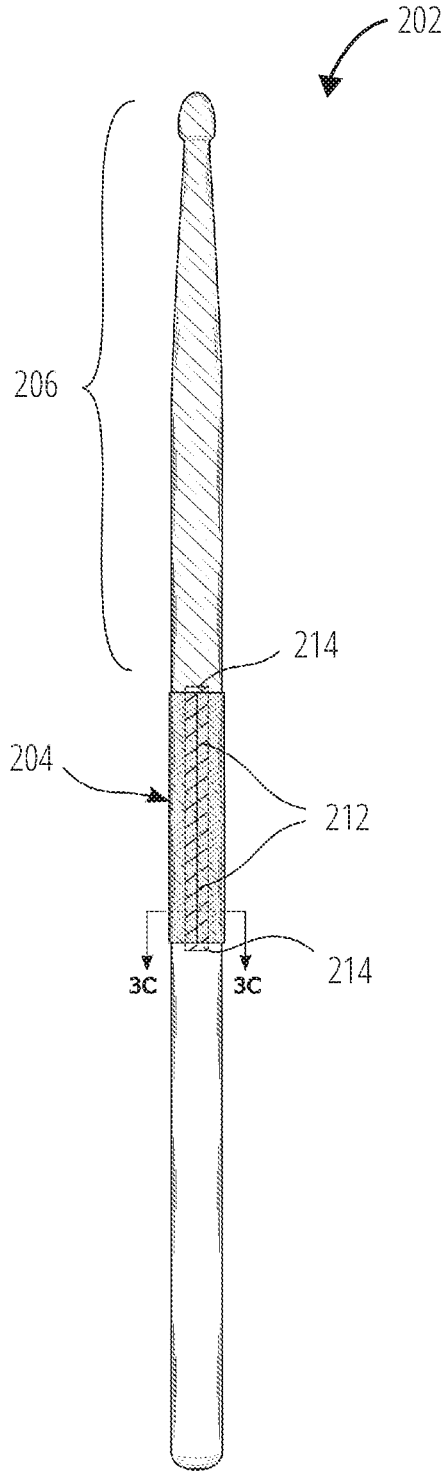
FIG. 2B is a side view of the extended play drumstick of FIG. 2A, also showing seam protective tape securing the seam of the durable surrounding pad.

FIG. 2B shows a side view of an extended play drumstick 202, including a durable surrounding pad 204 with an overlapping seam 212.

The overlapping seam 212 is protected and maintained in a closed configuration by seam protective tape 214, which is applied along the overlapping seam 212. The durable surrounding pad 204 and the seam protective tape 214 are applied along the rimshot portion 110 of the traditional drumstick 100 (shown in FIG. 1).

In some embodiments, the seam protective tape 214 is clear. In some embodiments, the seam protective tape 214 is made from PET plastic film. In some embodiments, the seam protective tape 214 is substantially 12 mm in width, and substantially 1 mil thick. In some embodiments, the seam protective tape 214 is at least 1.5 inches in length, and at least 0.2 inches in width.

In this embodiment, a durable coating 206 is applied to both the shoulder portion 106 and the tip portion 108 (both shown in FIG. 1), as explained for the embodiment of FIG. 2A.

Figure 3A:
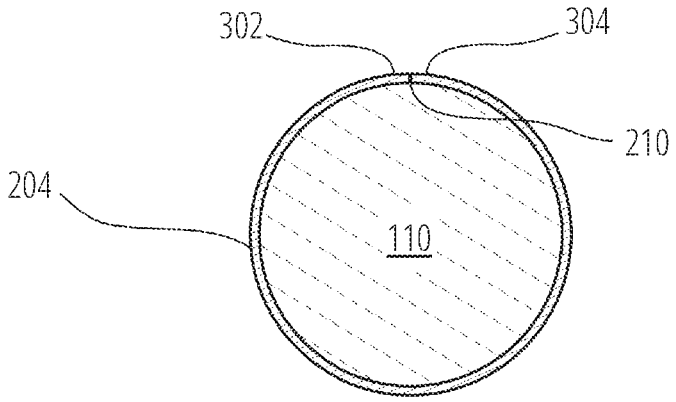
FIG. 3A is a cross-sectional view of the shaft portion of an embodiment of the extended play drumstick with a durable surrounding pad having an abutting seam.

FIG. 3A is a cross-sectional view of the rimshot portion 110 (shown in FIG. 1) of the extended play drumstick 200 (shown in FIG. 2A), with a durable surrounding pad 204 having an abutting seam 210. The abutting seam 210 is formed when the surrounding pad 204 is wrapped and attached by its adhesive backing around the rimshot portion 110 so that the opposing edges 302 and 304 meet in abutting relationship.

Figure 3B:
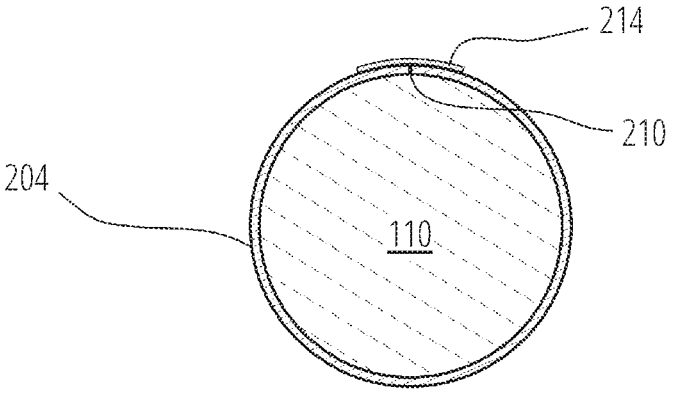
FIG. 3B is a cross sectional view of the shaft portion of an embodiment of the extended play drumstick with a durable surrounding pad having an abutting seam secured with seam protective tape.

FIG. 3B is a cross-sectional view of the rimshot portion 110 (shown in FIG. 1) of the extended play drumstick 200 (shown in FIG. 2A). This embodiment 200 includes a durable surrounding pad 204 having an abutting seam 210, and seam protective tape 214 applied over and along the abutting seam 210.

Figure 3C:
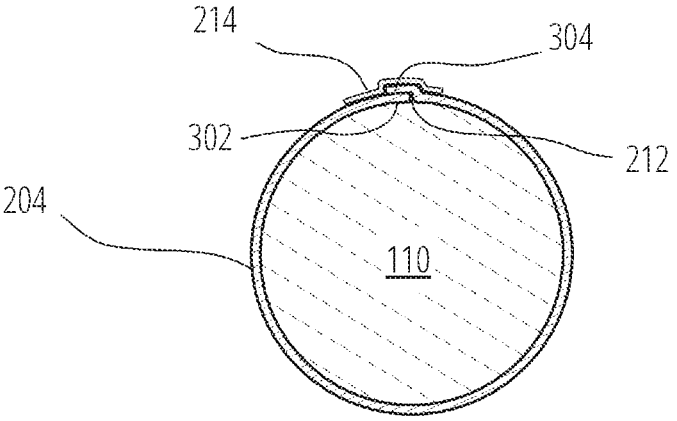
FIG. 3C is a cross sectional view of the shaft portion of an embodiment the extended play drumstick with a durable surrounding pad having an overlapping seam secured by seam protective tape.

FIG. 3C shows a cross section of the rimshot portion 110 (shown in FIG. 1) of the extended play drumstick 202 (shown in FIG. 2B), with a durable surrounding pad 204, an overlapping seam 212, and a seam protective tape 214 applied over and along the overlapping seam 212. The overlapping seam 212 is formed when the surrounding pad 204 is wrapped and attached by its adhesive backing around the rimshot portion 110 so that the opposing edges 302 and 304 meet in overlapping relationship.

Other modifications and implementations will occur to those skilled in the art without departing from the spirit and the scope of the invention as claimed. Accordingly, the above description is not intended to limit the invention, except as indicated in the following claims.

What is claimed is:

1. An extended play drumstick with enhanced durability, the extended play drumstick comprising:

a drumstick having: a butt portion, a shaft portion, a shoulder portion, a tip portion, and a rimshot portion extending along some of the shaft portion;

a durable surrounding pad attached along and around the rimshot portion, the durable surrounding pad having a distal end and a proximal end, the durable surrounding pad sized so as to form an overlapping seam when the durable surrounding pad is attached along and around the rimshot portion; and a durable coating applied to a surface of the shaft portion from at least the distal end of the durable surrounding pad up to and including at least the shoulder portion.

2. The extended play drumstick of claim 1, wherein the durable surrounding pad is attached to the rimshot portion by an adhesive.

3. The extended play drumstick of claim 1, wherein the durable surrounding pad includes an adhesive backing.

4. The extended play drumstick of claim 1, wherein the durable surrounding pad includes at least one of: poly-paraphenylene terephthalamide fiber, diaminodiphenylether-para-phenylenediamine-terephthaloyldichloride fiber, and carbon fiber.

5. The extended play drumstick of claim 1 further including: a seam protective tape applied over and along the overlapping seam.

6. The extended play drumstick of claim 5, wherein the seam protective tape is made from PET plastic film.

7. The extended play drumstick of claim 1, wherein the durable surrounding pad is between 2.5 and 4.0 inches in longitudinal length.

8. An extended play drumstick with enhanced durability, the extended play drumstick comprising:

a drumstick having: a butt portion, a shaft portion, a shoulder portion, a tip portion, and a rimshot portion extending along some of the shaft portion;

a durable surrounding pad attached along and around the rimshot portion, the durable surrounding pad sized so as to form an abutting seam when the durable surrounding pad is attached along and around the rimshot portion; and a seam protective tape applied over and along the abutting seam.

9. The extended play drumstick of claim 8, wherein the durable surrounding pad is attached to the rimshot portion by an adhesive.

10. The extended play drumstick of claim 8, wherein the durable surrounding pad includes an adhesive backing.

11. The extended play drumstick of claim 8, wherein the durable surrounding pad includes at least one of: poly-paraphenylene terephthalamide fiber, diaminodiphenylether-para-phenylenediamine-terephthaloyldichloride fiber, and carbon fiber.

12. The extended play drumstick of claim 8, wherein the durable surrounding pad is between 2.5 and 4.0 inches in longitudinal length.

* * * * *